United States Patent [19]

Sundberg

[11] Patent Number: 4,572,278

[45] Date of Patent: Feb. 25, 1986

[54] METHOD FOR CENTRIFUGAL CASTING

[75] Inventor: Yngve Sundberg, Västerås, Sweden

[73] Assignee: ASEA Aktiebolag, Västerås, Sweden

[21] Appl. No.: 563,826

[22] Filed: Dec. 21, 1983

[30] Foreign Application Priority Data

Jan. 28, 1983 [SE] Sweden ..... 8300436

[51] Int. Cl.[4] ..... B22D 13/00

[52] U.S. Cl. ..... 164/457; 164/114; 164/115

[58] Field of Search ..... 164/114, 115, 116, 286, 164/457, 155; 264/311

[56] References Cited

U.S. PATENT DOCUMENTS

| | | | |
|---|---|---|---|
| 1,040,517 | 10/1912 | Crawford | 164/115 |
| 1,783,094 | 11/1930 | Moore et al. | 164/152 |
| 3,941,181 | 3/1976 | Stoody | 164/114 |
| 4,377,196 | 3/1983 | Khandros | 164/114 |

FOREIGN PATENT DOCUMENTS

| | | | |
|---|---|---|---|
| 0717515 | 10/1954 | United Kingdom | 164/115 |
| 0447215 | 12/1974 | U.S.S.R. | 164/115 |
| 0791447 | 12/1980 | U.S.S.R. | 164/115 |

*Primary Examiner*—Nicholas P. Godici
*Assistant Examiner*—Richard K. Seidel
*Attorney, Agent, or Firm*—Kenyon & Kenyon

[57] ABSTRACT

A method for centrifugal casting involves mold rotation below the mean rotation speed during the casting and thereafter periodically varying the mold rotating speed so as to cause stirring throughout the wall thickness of the melt centrifugally held in the mold. This avoids the formation of snakes and blisters in the cast shape.

1 Claim, 3 Drawing Figures

METHOD FOR CENTRIFUGAL CASTING

Figure 1:
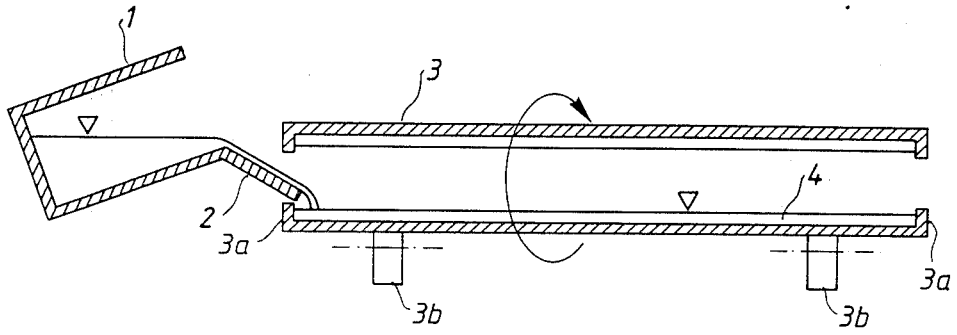

Molten metal is commonly centrifugally cast into cylindrical tubular shapes such as pipes. Iron and its alloys and other metals can be centrifugally cast.

For centrifugal casting of such shapes a cylindrical rotating mold having inwardly extending end flanges and a controllable rotation speed is used. A melt of molten metal is cast into one end of the rotating mold so as to form a melt volume in the mold providing the desired wall thickness for the cast shape. The rotation speed of the mold must be sufficiently high to cause the melt to centrifugally mold against the inside of the mold. The rotation of the mold is continued until the melt solidifies to form the tubular shape.

The slowest practical mold rotating speed is that which just safely centrifugally holds the melt against the inside of the mold, the maximum possible speed being the highest speed of which the centrifugal mold rotating equipment is capable.

It has been conventional for the foundryman in charge of the casting, to use a mean mold rotating speed or, in other words, to pick a value at least approximately mid-way between the two rotating speed extremes.

This conventional method for centrifugal casting is known to produce the cast shapes with spiral or coil-like grooves, called snakes, and blisters both of which are defects which desirably should be avoided.

The present invention is based on two observations. First, that when the melt is initially cast and is filling-in the mold, it forms a wave front flowing from the front end of the mold into which the metal is cast, to the other or back end of the mold, the wave front impinging on the mold's flange at the back end so as to propagate a wave motion in the melt in the mold causing the melt to form into a spiral shape in the rotating mold. During filling-in and thereafter, the melt does not immediately rotate at the rotating speed of the mold, particularly throughout its inner portion. Therefore, the propagated wave motion can cause a twisting of the melt into the spiral shape which freezes in the portion of the melt in contact with the mold during initial solidification of the melt in the mold. Although the propagated wave motion may thereafter quiet down, a snake remains in the shape's surface after complete solidification of the melt in the mold. Secondly, it was found that the blisters are the result of the cylindrical tubular melt in the rotating centrifugal mold, also solidifying on its inside portion while solidifying on its outside portion held against the inside of the mold.

According to the invention, to prevent the formation of snakes the mold rotation speed is reduced below the conventional mean rotation speed, during the filling-in of the melt into the mold. This reduces the velocity of the wave front of the melt traveling towards the back end of the mold. The rotation speed must be high enough to keep the melt centrifugally held against the inside of the mold but low enough, below the mean speed, to keep the wave front velocity of the melt low enough so that when the melt reaches the back end flange of the mold there is inadequate wave front energy to propagate a substantial wave back through the melt. After the mold is filled in and with the melt free, or substantially free from wave action, the rotating speed of the mold can be picked-up to the mean speed conventionally used. The solidified casting should be free from snakes.

To avoid the formation of blisters, during solidification the rotating speed of the mold is periodically varied to speeds from slightly above to slightly below the mean speed of rotation. The portion or layer of the melt in contact with the mold varies in speed substantially correspondingly in its rotation speed while the inside or layer-like portion of the melt lags behind in its rotation speed. In other words, when the outer portion of the centrifugally shaped melt cylindrically speeds up, the inner portion through its inertia tends to lag behind, and when the outer portion of the melt slows down the inner portion because of its momentum lags behind in attaining the lower speed. The result is a constant stirring together of the cylindrical tubular melt throughout its wall thickness during solidification, thus avoiding blisters by preventing premature solidification of the inside portion of the melt.

Figure 2:
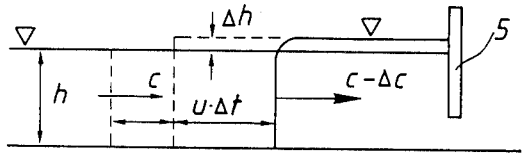
Figure 3:
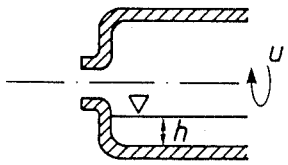

The principals of this invention are explained in detail hereinafter with the aid of the accompanying schematic drawings in which the various views are as follows:

FIG. 1 in vertical cross section shows the centrifugal casting mold and a ladle used for casting the melt, and FIGS. 2 and 3 illustrate equations which are to be found in the following:

In FIG. 1 the melt is being tapped or poured from a ladle 1 by way of a spout 2 into the front end of the rotating centrifugal casting mold 3 having the end flanges 3*a*. The volume cast is proportioned to fill in the mold with the centrifugally held tubular melt of the ultimately desired wall thickness of the shape being cast, as indicated at 4. In some instances the mold is declined instead of being horizontal as shown. During the initial filling-in the melt flows from the front end to the back end of the mold with a wave front which impinges on the flange at the back end of the mold. The rotative speed of the mold should be kept enough below the mean speed to prevent the formation of a high velocity wave front. The mold can be rotated as by means of controllable speed rollers 3*b* as is usual, and after the filling-in during solidification of the melt the speed should be varied periodically as for example by about 10% from the mean speed, rapidly enough to effectively stir the melt 4.

The method of solving the snake formation problem can be mathematically explained as follows:

The starting point is Joukowsky's theory of a propagating wave in an open channel (see FIG. 2).

If the door 5 is suddenly brought down, there will arise a propagating wave along the channel.

If $\rho$ is the density of the melt, b is the width of the melt, h is the height of the channel, c is the velocity of flow of the melt, g is the acceleration of gravity, t is the time, and u is the velocity of the wave front, according to the law of forces the following is valid:

$$gpbh\,\Delta h = \rho(u + c)\Delta t\, bh \frac{\Delta c}{\Delta t}$$

from which $$\Delta h = \frac{u + c}{g}\,\Delta c \qquad (1)$$

(the wave front height). (1)

The continuity equation is as follows:

$$b(c-\Delta c)\Delta t(h+\Delta h)+u\Delta t\Delta hb=c\Delta tbh. \quad (2)$$

Equations (1) and (2) together give $$u+c=\sqrt{gh} \quad (3)$$

If c=0, the velocity of the wave front is as follows:

$$u=\sqrt{gh} \text{ (see FIG. 3).} \quad (4)$$

It is clear from equation (4) that the gravity is important for the velocity u.

In a rotating, cylindrical mould, the gravity is replaced by the centrifugal acceleration $$a = \frac{v^2}{r},$$

where v=the peripheral speed, r=the inner radius of the mould. Thus, by varying the speed of rotation, the velocity of the wave front can be influenced.

Example: A mould with the inside radius r=0.1 m rotating at n=1000 r/m. This gives the following peripheral speed:

$$v = 2\pi \frac{n}{60} r = 2\pi \frac{1000}{60} 0.1 = 10.5 \text{ m/s.}$$

The centrifugal acceleration is as follows:

$$a = \frac{10.5^2}{0.1} - 1097 \text{ m/s}^2 = 112 \text{ g.}$$

Further, it is assumed (see FIG. 3) that h=0.02 m. The equation (3) gives $u=\sqrt{112\ g\times 0.02}=4.69$ m/s.

This speed is great and can explain why a "snake" is formed at the start of the casting process. The speed is decreased by reducing the speed of rotation.

When the initial stage is over, there may be reasons to increase the speed of rotation in order that the wall thickness shall be sufficiently even.

Regarding the problem of solidification from the inside, the following may give an idea of the required amplitude of the superimposed periodic variation of the speed of rotation. In the above example, a peripheral speed of 10.5 m/s was obtained. Thus, if the speed of rotation is varied by 10% with sufficiently high frequency, the melt at the inside radius will not have time to "participate in" the variation, so a relative speed of about 1 m/s between the melt at the inside radius and the melt at the solidification front will be obtained. The relative speed shall be sufficient to create turbulence.

What is claimed is:

1. A method for centrifugally casting a cylindrical tubular shape in a cylindrical rotating mold having inwardly extending end flanges and a controllable rotation speed, the mold forming a casting with a substantially even wall thickness when rotated at a mold rotating mean speed, comprising pouring a melt of molten metal into one end of the rotating mold so the melt fills-in the mold to form a melt volume in the mold providing a desired wall thickness for the cast shape, the pouring melt while filling-in the mold forming a wave front flowing to the other end of the mold and against the flange at that end, the wave front having a velocity dependent on the mold's rotation speed, and controlling the rotation speed of the mold during filling-in with the melt to a speed substantially slower than said mean speed and holding the velocity of said wave front low enough to prevent the wave front from reacting with the flange at said other end of the mold and propagating a wave motion in the melt causing the filling-in melt to form into a spiral shape in the mold, the lower rotation speed being maintained at least at a speed high enough to centrifugally hold the melt on the inside of the mold during filling-in of the mold, and after the filling-in of the mold and the melt is substantially free from said wave motion and before the melt solidifies, increasing the mold's rotating speed to a higher speed which varies above and below said mean rotating speed at a frequency causing the outer portion of the melt closest to the mold to substantially correspondingly vary in rotation speed while the inside portion of the melt lags in its rotation speed relative to that of the outer portion and stirs together said portions of the melt during solidification, preventing premature solidification of said outer portion and formation of blisters in the as-cast tubular shape.

* * * * *